United States Patent [19]

Arpaia

[11] Patent Number: 4,656,987

[45] Date of Patent: Apr. 14, 1987

[54] PRESSURIZED FUEL CARBURETOR FOR AN INTERNAL COMBUSTION ENGINE

[76] Inventor: Michael A. Arpaia, 1540 Flower St., Glendale, Calif. 91209

[21] Appl. No.: 637,964

[22] Filed: Aug. 6, 1984

[51] Int. Cl.[4] ..... F02M 39/00

[52] U.S. Cl. ..... 123/463; 123/568; 123/516; 261/36.2; 261/50.2

[58] Field of Search ..... 123/179 L, 463, 462, 123/464, 514, 516, 568; 261/50 A, 39 R, 36 A

[56] References Cited

U.S. PATENT DOCUMENTS

| | | | |
|---|---|---|---|
| 3,306,033 | 2/1967 | Cornelius | 123/568 |
| 3,953,547 | 4/1976 | Schoeman | 261/50 A |
| 4,206,735 | 6/1980 | Miles | 123/464 |
| 4,228,777 | 10/1980 | Haase | 123/463 |
| 4,257,379 | 3/1981 | Hickling | 261/50 A |
| 4,348,338 | 9/1982 | Martinez | 123/578 |
| 4,360,481 | 11/1982 | Kaufman | 261/39 R |
| 4,434,110 | 2/1984 | Highfield | 261/36 A |

FOREIGN PATENT DOCUMENTS

| | | | |
|---|---|---|---|
| 2620885 | 12/1976 | Fed. Rep. of Germany | 123/462 |

*Primary Examiner*—Carl Stuart Miller
*Attorney, Agent, or Firm*—Sellers and Brace

[57] ABSTRACT

Disclosed is a pressurized fuel carburetor system for an internal combustion engine. The sole movable component in the air intake passage is an accelerator-actuated throttle valve device operatively associated with a single fuel metering valve and with an automatic manifold pressure sensor operable to enrich and lean the fuel-air mixture. A fuel pressure regulator cooperates with a fuel pump and with a fuel return restricter connected to and governed by changing intake manifold pressure conditions to regulate fuel pressure at the inlet side of the fuel metering valve. A normally closed fuel check valve prevents flow to the fuel metering valve except when the accelerator is depressed. Pressurized fuel is subjected to multiple vaporizing stages including a first stage as it expands in escaping through the metering valve, thence through a set of small ports into a second expansion chamber and thereafter through a multiplicity of jets into flowing air hot exhaust gases in the air intake passage.

22 Claims, 15 Drawing Figures

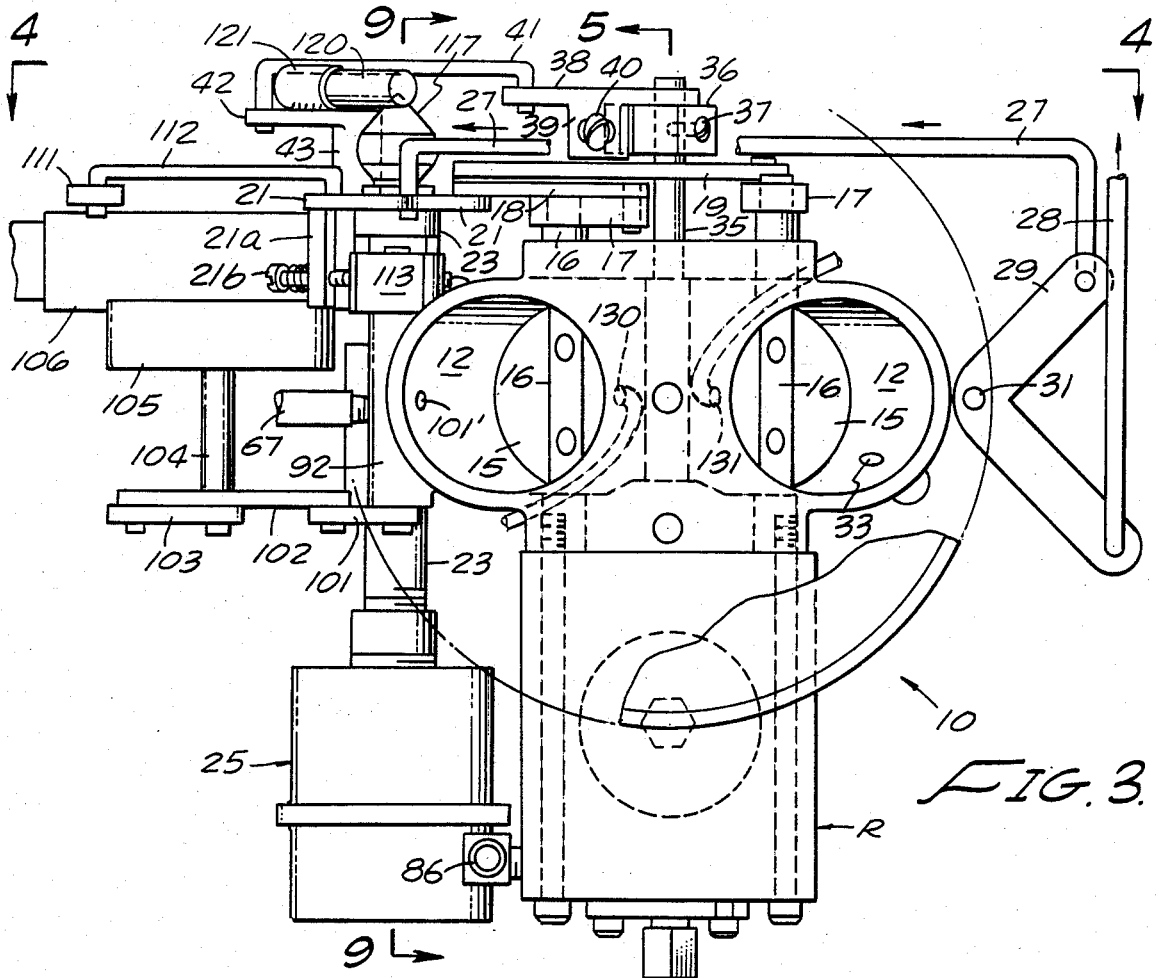
FIG. 3.
FIG. 4.
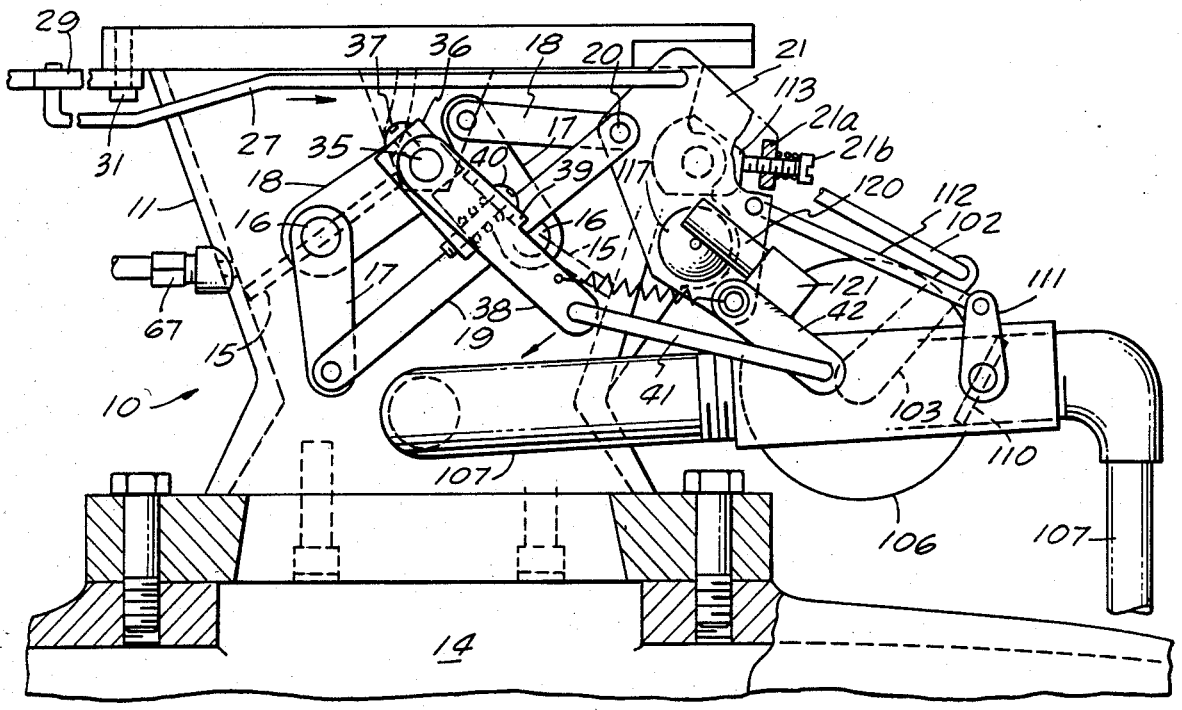

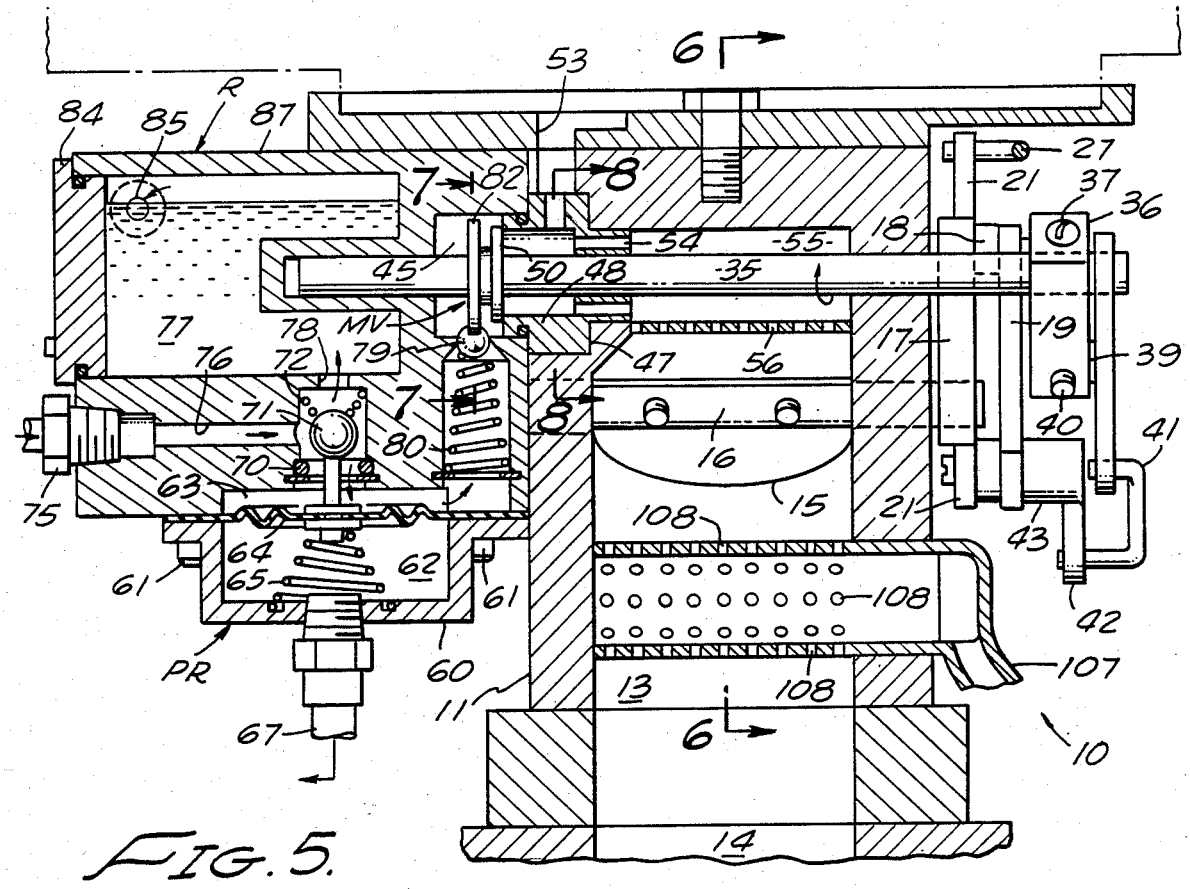
FIG. 5.
FIG. 6.
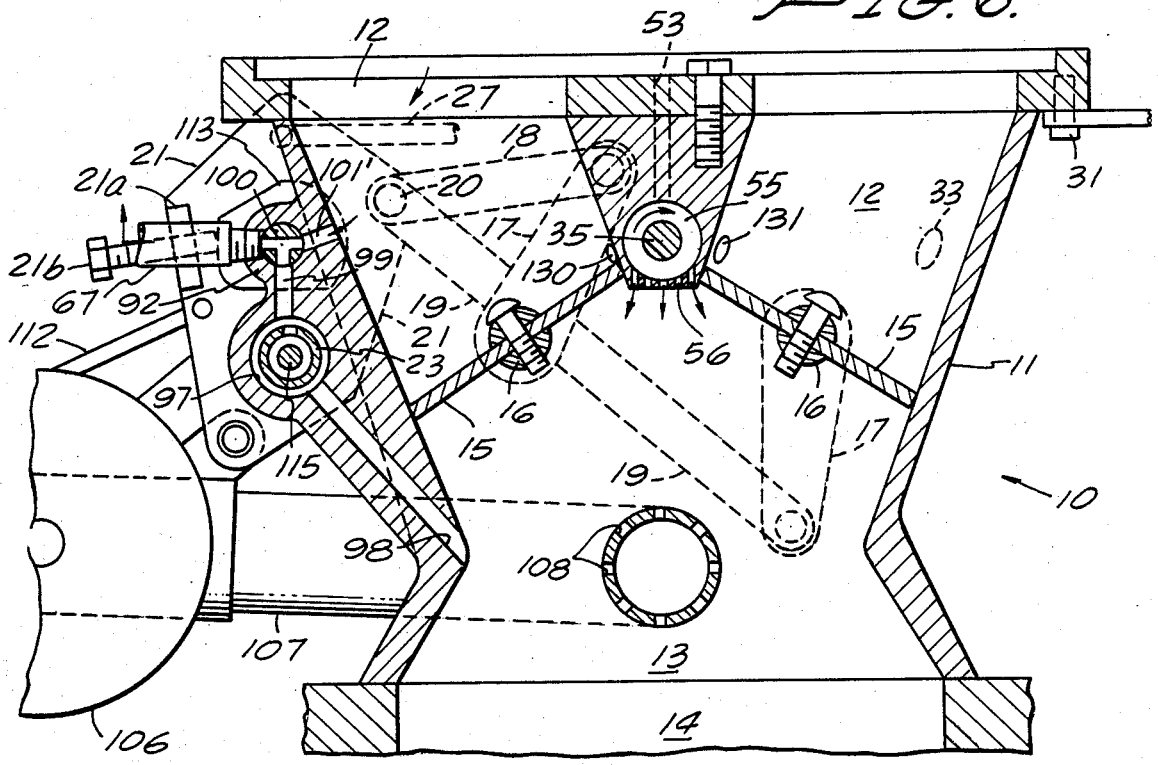

FIG. 7.
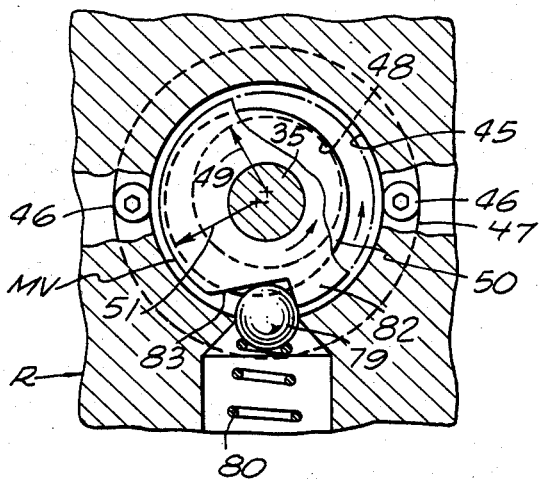
FIG. 8.
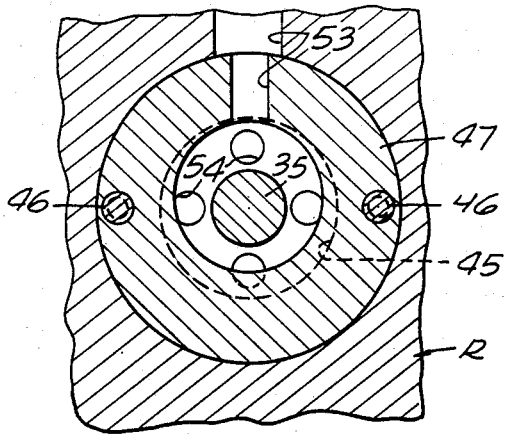
FIG. 9.
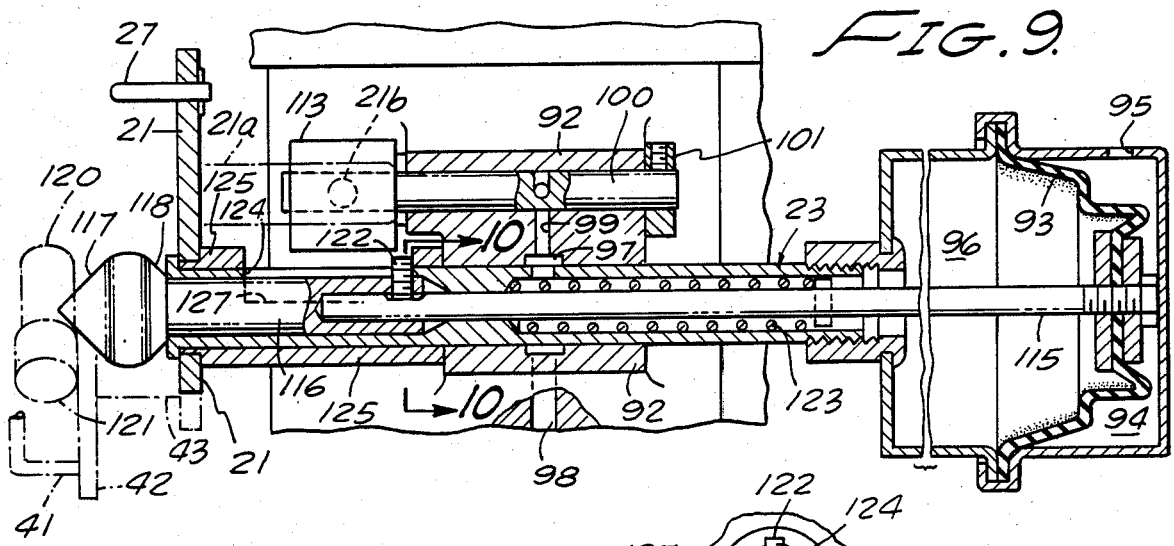
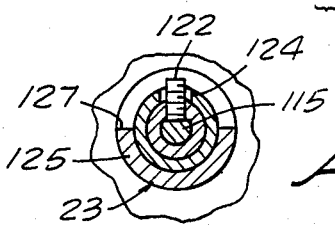
FIG. 10.
FIG. 11.
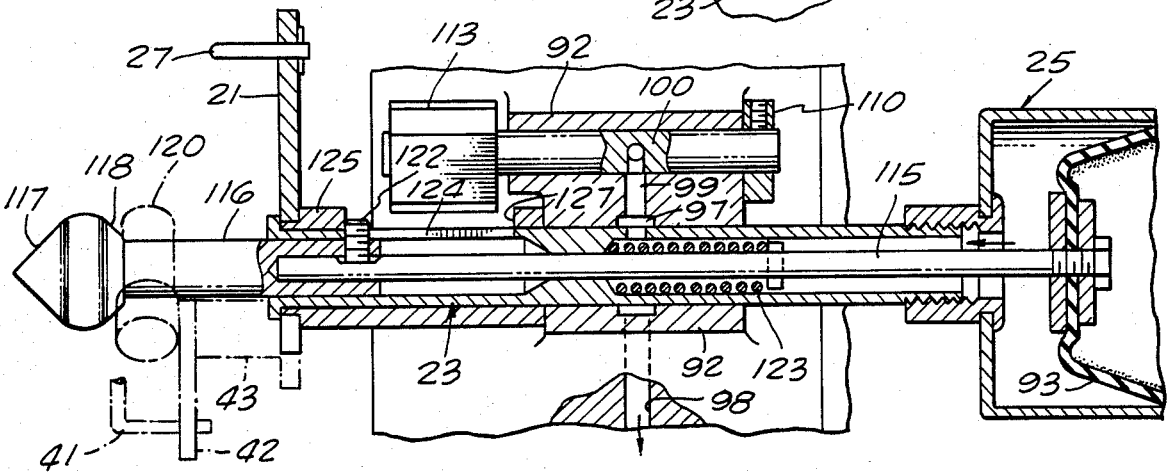

COLD ENGINE, OFF, NO VACCUM, NOT RUNNING.

COLD-IDLE POSITION ENGINE RUNNING

ENGINE RUNNING, HOT, IDLE

HOT, ENGINE ACCELERATION

PRESSURIZED FUEL CARBURETOR FOR AN INTERNAL COMBUSTION ENGINE

This invention relates to engine carbureting systems, and more particularly to a unique pressurized fuel caeburetor having throttle valve means as the only movable component in the air intake passage, which throttle valve is operatively connected to the accelerator and to a single pressurized fuel metering valve coupled to mechanisms for automatically enriching and leaning the fuel mixture and for regulating the fuel pressure.

BACKGROUND OF THE INVENTION

Innumerable widely varying proposals have been made heretofore for providing internal combustion engines with the most efficient and precisely controlled conditions to meet the wide range operating requirements of internal combustion engines. These proposals fall into many categories including carburetors utilizing float controlled fuel bowls, both mechanically and electronically controlled fuel injection systems, systems using gaseous fuel supplied from pressurized tanks or converted to gas from a pressurized liquid supply, and carburetion systems designed to release pressurized fuel into the air intake passage via an operator-controlled metering valve.

This invention relates to the last mentioned category, different illustrated embodiments of which are disclosed in my prior U.S. Pat. Nos. 2,846,597; 3,053,242; 3,224,425; and 3,373,725. The objective sought to be served in each of these constructions was the avoidance of certain shortcomings and disadvantages of prior carbureting systems, particularly those in widespread use in automotive equipment and utilizing float bowl type carburetors. Other important objectives were to provide for most positive control of a fuel and a very substantial reduction in the release of unburned fuel to the atmosphere including smog producing constituents. In my three earlier patents listed above, these objectives were served in major part by cutting off all fuel flow during major portions of vehicle coasting and deceleration with the provision of means for automatically resuming fuel supply and restarting the engine as the vehicle approached a stop condition.

My latest and last issued patent avoided the anticipated reluctance of drivers to be on the highway with a non-operating engine during coasting and deceleration by eliminating the temporary fuel cut-off feature but, as in each of my patents, this carburetor also relied upon flow sensing means in the carburetor air intake passage. Such movable flow sensing means objectionably obstruct the efficient flow of fuel and air and introduce inherently delay and provide slow response to the desired rapid response to fuel enriching and leaning needs for smooth and high efficient engine operation. These prior pressure sensing expedients also cause rough engine operation, stumbling and stalling.

SUMMARY OF THE INVENTION

The present invention avoids the many disadvantages and shortcomings of prior carburetion systems for internal combustion engines in a highly efficacious manner. In an illustrated embodiment, the main housing is provided with a Y-shaped air intake passage, each intake branch being provided with a normally closed throttle valve operatively connected to the vehicle accelerator and to a single metering valve controlling the admission of regulated pressurized fuel to a three-stage vaporizing passage discharging into the intake passage immediately below the throttle valves. The fuel supply for the metering valve is connected to a closed fuel supply tank by an engine-driven fuel pump, a fuel pressure regulator and an excess fuel flow restricter. Operation of the pressure regulator is controlled by thermal operation of a valve selectively connecting the pressure regulator with either the inlet or the outlet side of the throttle valve. When the engine is cold a higher fuel pressure is advantageous and this is assured by a three-way valve positioned to connect the pressure regulator diaphragm to the atmospheric side of the throttle valve. As the engine warms, a thermostat connects the fuel pressure regulator to the manifold side of the throttle valve whereupon the pressure regulator reduces the fuel pressure on the inlet side of the metering valve and maintains it at a substantially lower positive pressure during subsequent engine operation. The fuel pressure regulator automatically enriches and leans the fuel as the intake manifold pressure increases and decreases.

The automatic flow restricter serves several functions including the return of excess fuel to the tank, venting the vapor space in the supply tank to the outlet side of the fuel metering valve and, additionally and importantly, it acts as an accumulator to momentarily increase the fuel pressure on the inside of the metering valve during rapid acceleration.

The automatic fuel enriching and leaning auxiliary of this invention is located entirely outside the air intake passage and includes a manifold pressure sensor in communication with the carburetor air intake passage. Its manifold pressure sensing diaphragm shifts a specially constructed cam crosswise of the throttle and fuel valve operating linkage to actuate the fuel metering valve independently of the accelerator and in a manner to automatically enrich or lean the fuel supply to meet engine needs.

Further features include means for supplying varying amounts of warm exhaust gas to the fuel mixture entering the intake manifold, and a check valve at the entrance of the fuel metering valve which remains closed until the accelerator is depressed.

Accordingly, it is a primary object of this invention to provide an improved carburetion system and method for an internal combustion engine provided with a high efficiency arrangement for supplying pressurized fuel to the carburetor air intake passage unobstructed by movable components other than an accelerator actuated throttle-valve means.

Another object of the invention is the provision of a carburetor for an internal combustion engine having automatic means responsive to changes in the carburetor air intake passage to regulate the pressure of pressurized liquid fuel supplied to an accelerator-actuated fuel metering valve.

Another object of the invention is the provision of a carburetor equipped with a pressurized fuel metering valve and with manifold pressure sensing means located entirely exteriorly of the carburetor and responsive to the changing manifold pressure to enrich and to lean the fuel mixture.

Another object of the invention is the provision of a pressurized fuel carburetion system for an internal combustion engine having a fuel metering valve constructed to supply the fuel to the intake manifold via a three-stage fuel vaporizer.

Another object of the invention is the provision of a pressurized fuel carburetion system wherein pressurized fuel is supplied to a fuel metering valve via a pressure regulator responsive to changing pressure conditions in the carburetor air intake passage and including an excess fuel return line equipped with a flow restricter and automatic momentary pressure booster.

Another object of the invention is the provision of a pressurized fuel carburetion system for an internal combustion engine having flow restrictor in an excess fuel return line responsive to abrupt acceleration to boost the fuel pressure at the metering valve to provide smooth, powerful acceleration while avoiding engine stumbling and stalling.

Another object of the invention is the provision of a pressurized fuel carburetion system equipped with a fuel metering valve and means for maintaining the metering valve closed when the engine is not operating.

Another object of the invention is the provision of a pressurized fuel carburetor having means responsive to engine exhaust temperature to selectively control the fuel pressure regulator to maintain a higher fuel pressure during engine warmup.

Another object of the invention is the provision of a pressurized fuel carburetion system in which liquid fuel is supplied into the intake manifold via a multistage fuel vaporizer discharging into a heated portion of the intake manifold immediately downstream from the throttle valve.

Another object of the invention is the provision of a pressurized fuel carburetor wherein the only movable component in the intake manifold is an accelerator controlled throttle valve and which carburetor is equipped with a manifold pressure sensor confined to the exterior of the carburetor and automatically responsive to intake manifold pressure conditions to enrich and to lean the fuel mixture in response to abrupt changes in manifold pressure.

These and other more specific objects will appear upon reading the following specification and claim and upon considering in connection therewith the drawings to which they relate.

Referring now to the drawings in which a preferred embodiment of the invention is illustrated:

FIG. 3 is a fragmentary top plan view similar to FIG. 1 but showing portions of the carburetor top structure broken away to expose the accelerator controlled operating linkage to view;

FIG. 4 is a front elevational view of the operating linkage taken along line 4—4 on FIG. 3;

FIG. 5 is a vertical sectional view taken along line 5—5 on FIG. 3 and showing along the left side the fuel pressure regulator connected to the inlet of the fuel metering valve and showing details of the multi-stage fuel vaporizer and one of the twin throttle valves;

FIG. 6 is a cross-sectional view taken along line 6—6 on FIG. 5 showing the throttle valves fully closed along with portions of the throttle operating linkage;

FIG. 7 is a cross-sectional view of portions of the fuel metering valve taken along line 7—7 on FIG. 5;

FIG. 8 is a cross-sectional view taken along line 8—8 on FIG. 5 and showing the entrance to the second stage of the fuel vaporizer;

FIG. 9 is a cross-sectional view of the automatic manifold pressure sensor taken along line 9—9 on FIG. 3;

FIG. 10 is a fragmentary cross-sectional view taken along line 10—10 on FIG. 9;

FIG. 11 is a cross-sectional view of the automatic pressure sensor with the engine either off or in full acceleration;

Figure 12:
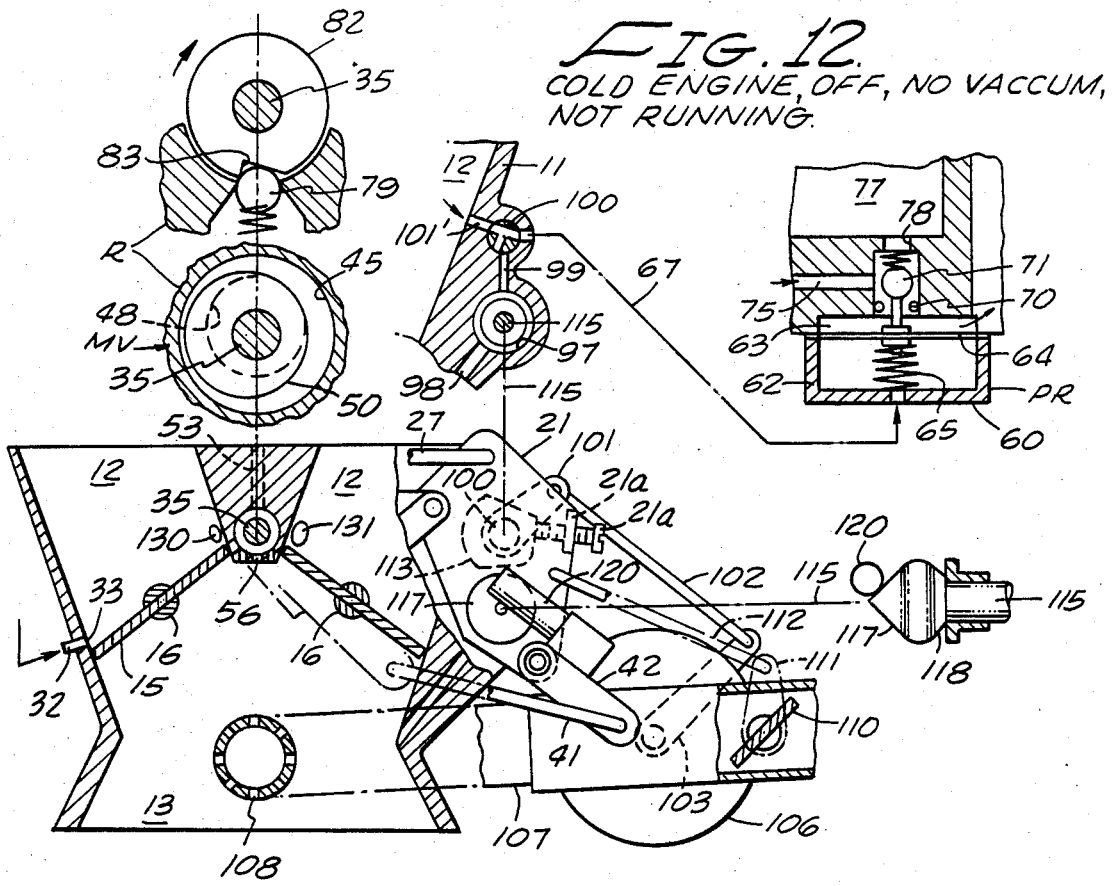
Figure 13:
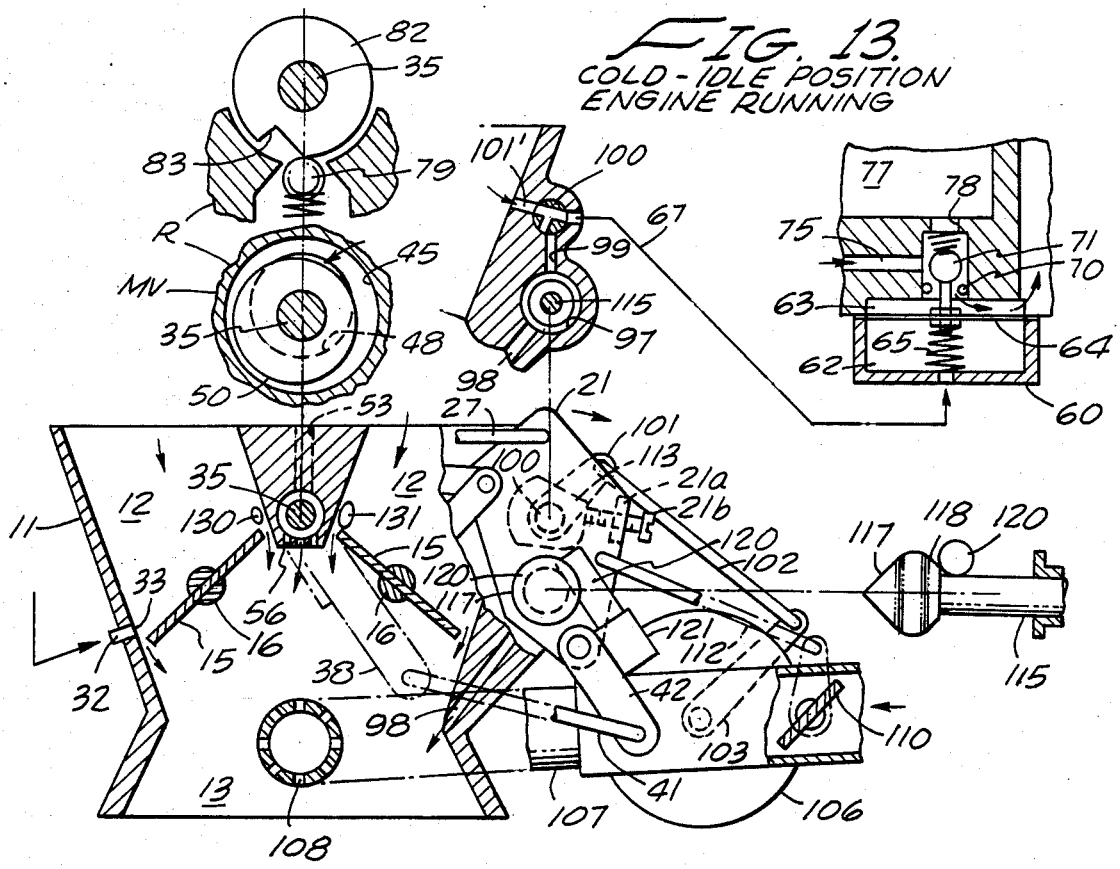
Figure 14:
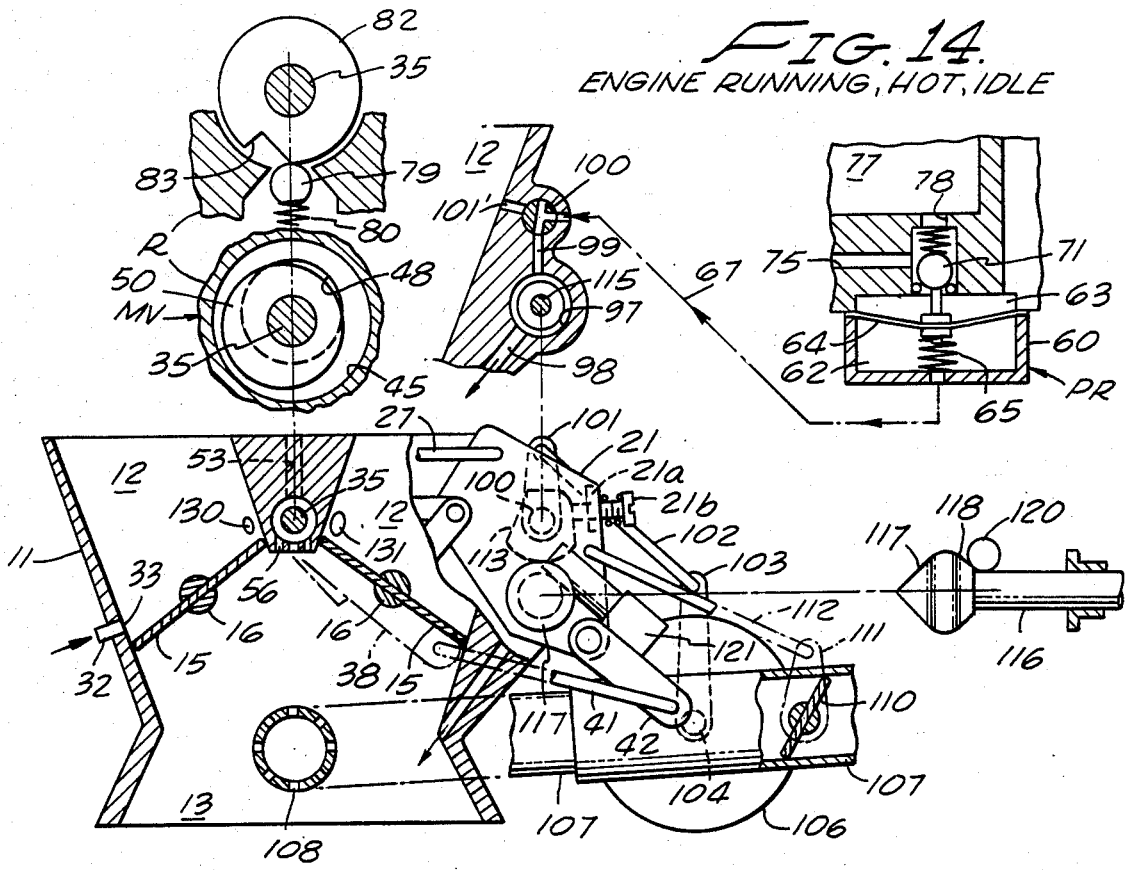
Figure 15:
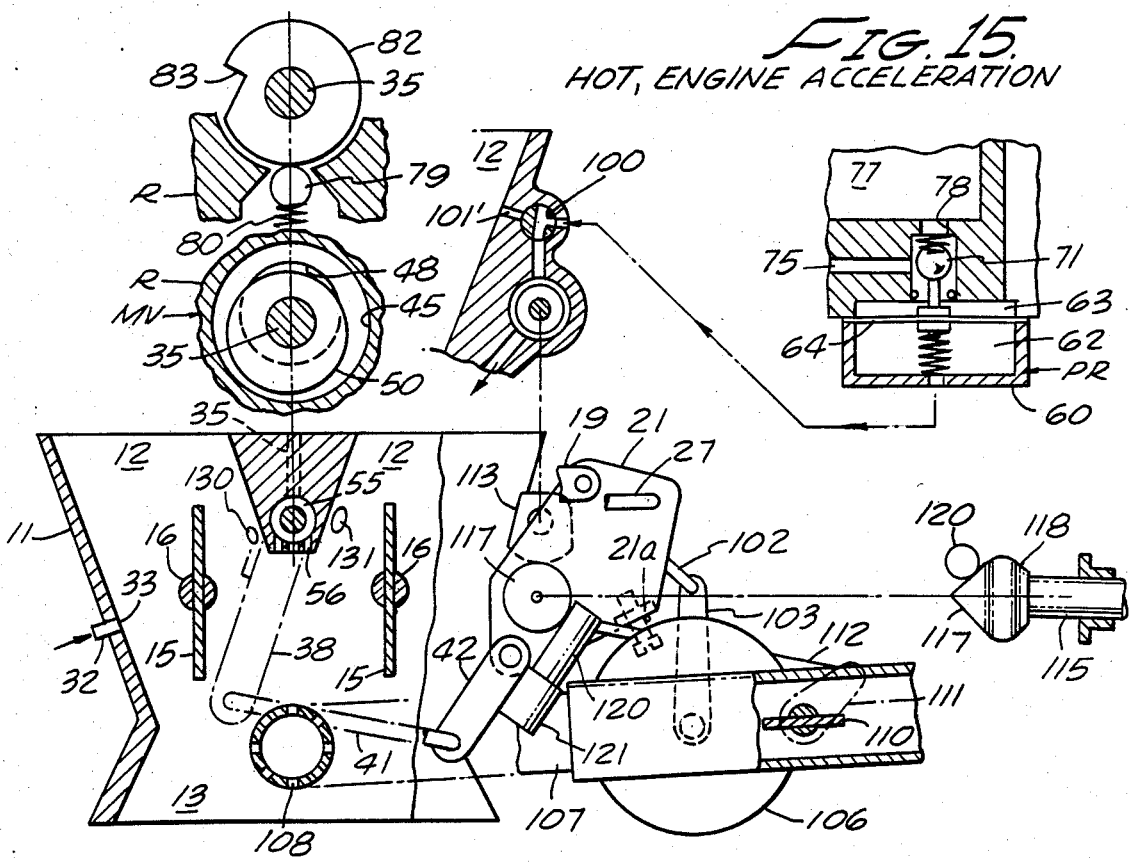

FIG. 12 is a fragmentary generally schematic view showing the relative positions of certain components when the engine is not operating with parts of the metering valve located in the upper left-hand corner; the 3-way valve for the fuel pressure regulator in the upper central portion; the fuel pressure regulator in the upper right-hand corner; and the fuel enriching and leaning cam retracted and located below the pressure regulator;

FIG. 13 is a schematic view similar to FIG. 12 but showing the same components with the engine running in cold idle position;

FIG. 14 is a schematic view similar to FIG. 12 but showing the same components in the position occupied with the engine running in a hot idle state; and FIG. 15 is a schematic view similar to FIG. 12 but showing the carburetor components in the position occupied with the engine hot and accelerating.

ACCELERATOR-CONTROLLED THROTTLE LINKAGE

Referring initially and more particularly to FIG. 1 to 6, there is shown an illustrative embodiment of the carburetor designated generally 10. The main housing 11 has a Y-shaped air intake passage comprising a pair of downwardly converging passages 12, 12 merging with the Y stem portion 13 which discharges into the engine intake manifold 14. The air inlet to passages 12,12 faces forwardly is controlled by a pair of normally closed throttle valves 15,15 mounted on shafts 16, 16, the outer ends of which are keyed to operating arms 17,17. The outer ends of these arms are connected by separate links 18 and 19 to a shouldered pin 20 mounted in a broad 5-sided link 21 pivotally supported on a sleeve 125 (FIG. 9) journalled on the stationary tubular housing 23 of the manifold pressure sensor, designated generally 25, best shown in FIGS. 9 and 11. The upper end of the 5-sided link 21 is connected to a conventional vehicle accelerator pedal 30 (FIG. 1) by operating links 27,28 and a bell crank 29 pivotally supported by pivot pin 31 on the exterior of the carburetor housing (FIG. 4).

From the foregoing it will be apparent that when the operator depresses the accelerator 30 counterclockwise about its pivot and in opposition to its spring bias, the described linkage pivots throttle valves 15,15 from the normally fully closed position thereof shown in FIG. 6, 12 to an open position such as the cold engine idle position shown in FIG. 13. Upon release of the accelerator pedal its torsion spring returns the throttle valves to their fully closed position.

THE PRESSURIZED FUEL SUPPLY AND METERING COMPONENTS

Figure 1:
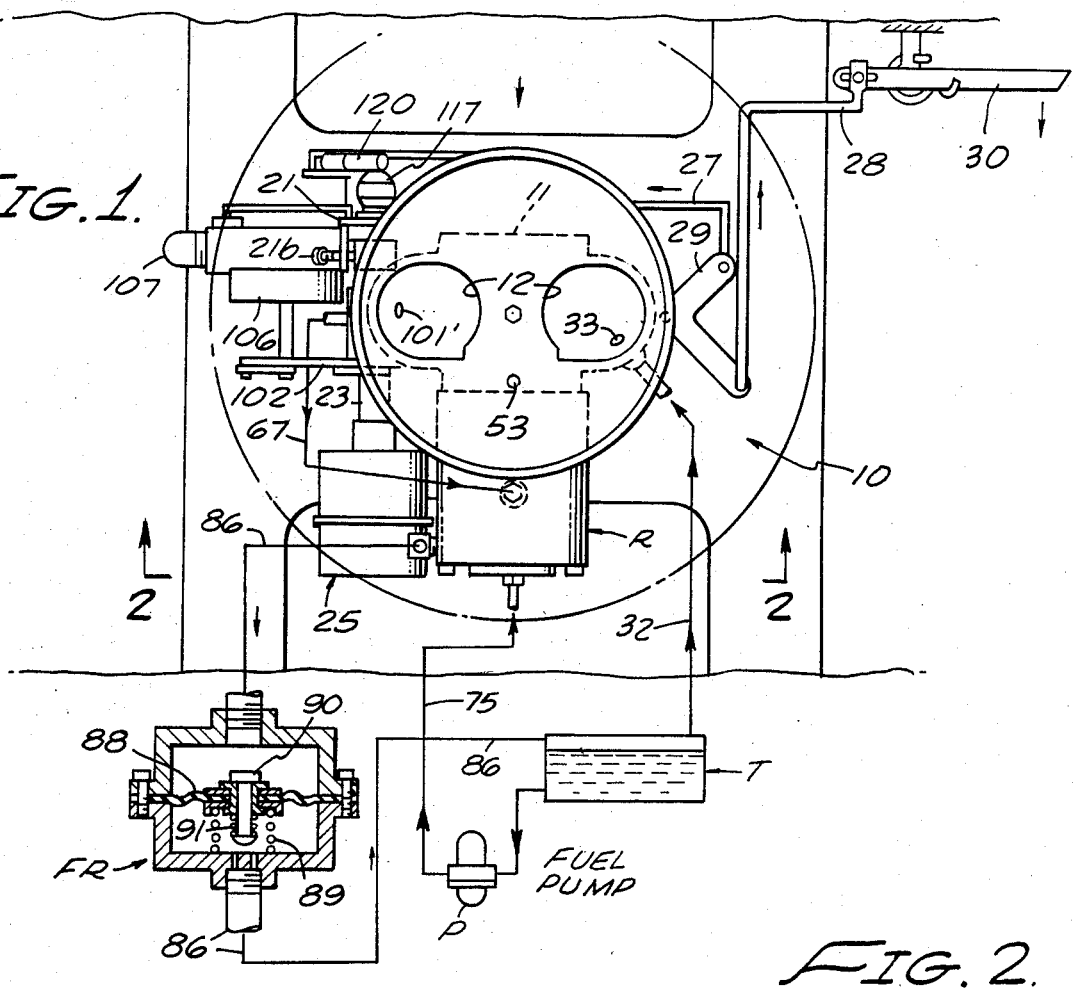
FIG. 1 is a top plan view of an illustrative embodiment of the invention carburetor installed on an engine and including ducting connecting the carburetor to the supply tank, the fuel pump, and the excess fuel flow restricter and pressure accumulator.
Figure 2:
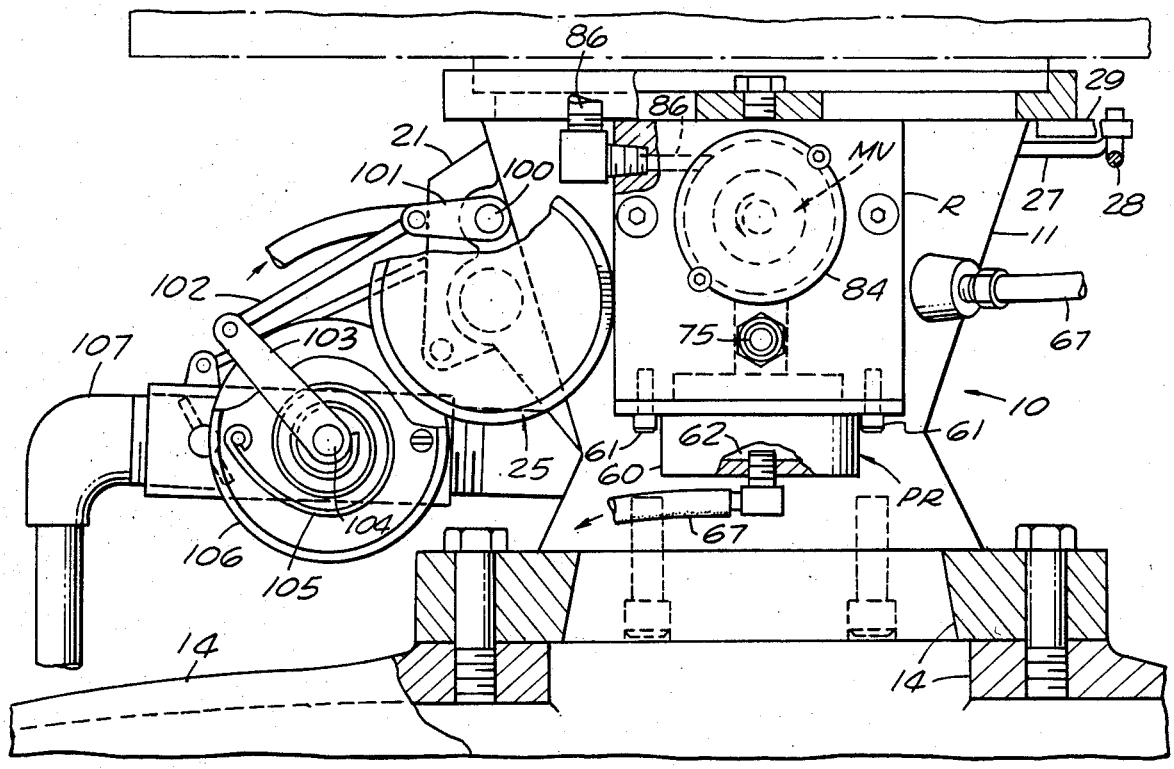
FIG. 2 is a rear-end elevational view taken along line 2—2 on FIG. 1.

The pressurized fuel metering and supply components will now be described with reference to FIGS. 1 and 5. The fuel supply is maintained in the closed vehicle fuel tank T from which it is pumped by pump P to a pressure regulator PR (FIG. 5) which discharges the fuel into a reservoir R on the side of the carburetor housing and the inlet side of the fuel metering valve MV. Excess fuel is returned to fuel tank T by way of the flow restricter FR. Conduits interconnecting these components are best shown in FIG. 1 and will be described presently in connection with the individual components. These conduits include a conduit 32 connecting the vapor space of the fuel tank T to a port 33 (FIGS. 12–15) in the carburetor intake passage 12 so that this vapor can be usefully consumed.

The meterinq and vaporizing components are best shown in FIGS. 5 and 6. Metering valve MV is mounted on a rotary shaft 35 extending crosswise of the carburetor housing closely adjacent the merger of the air intake passages 12,12 (FIG. 6). The right-hand end of this shaft as viewed in FIG. 5 projects outwardly crosswise of the throttle valve linkage to which shaft 35 is connected by a crank arm 36 and a set screw 37. Crank arm 36 includes a second arm 38 having its upper end pivoted on valve shaft 35. Arm 38 has a tang 39 extending laterally from its mid portion of arm 38 and extending crosswise of arm 36 to which it is adjustably secured by a screw 40. Adjustment of this screw facilitates the fine adjustment of arms 36 and 38 about the axis of valve shaft 35. The outer end of arm 38 is connected by link 41 (FIGS. 3,4) to the outer end of an L-shaped arm 42 having its shorter leg 43 pivoted to the lower end of the 5-sided link 21. From the foregoing it will be apparent that operation of the accelerator pedal is operable through the described linkage to rotate the throttle valves and the shaft 35 of metering valve MV between their respective open and closed positions.

The fuel metering valve MV is located in a well 45 of the pressurized fuel reservoir R clamped in a fluid tight manner to the carburetor housing by a pair of cap screws 46 (FIGS. 7,8). Surrounding valve shaft 35 is a tubular fitting 47 (Fiqures 5,7,8), the axis of which is offset upwardly from the axis of valve shaft 35 by a suitable distance such as 0.025 inches. The well 48 (FIG. 5) on the outlet side of the metering valve has a radius indicated by arrow 49 in FIG. 7 and its rim edge is offset upwardly from the axis of shaft 35 by the aforementioned distance of 0.025 inches represents the stationary seat of the metering valve. Cooperating with this valve seat is a circular valve disk 50 fixed to valve shaft 35 and having its axis offset to the left of the shaft axis by a suitable distance such as 0.025 inches. Corresponding values for the diameters of well 48 and disk 50 are 0.531 inches and 0.587 inches respectively. The radius of the circular valve disk is indicated by arrow 51 in FIG. 7.

The multiple stage fuel vaporizing facilities associated with the metering valve MV include a first-stage vaporizing chamber provided by well 48 in fitting 47. An idle air inlet passage 53 in communication with the atmosphere opens into the well 48 through a lateral passage in fitting 47 and mixes with the pressurized fuel entering past the rim of valve disk 50 in its initial slightly open position. As shown in FIGS. 5 and 7, the metering disk 50 is fully closed. The bottom of well 48 in fitting 47 includes a plurality of ports 54 through which the fuel and idle air escape into a second stage vaporizing chamber 55 embracing the valve shaft 35. Further vaporization of the fuel occurs in this chamber, bottom of which has a multiplicity of perforations 56 through which the fuel and idle air escape (FIGS. 5 and 6) into the low pressure existing in the air intake passage 13 immediately downstream from the edge of the slightly open throttle valves 15.

FUEL PRESSURE REGULATOR

The fuel pressure regulator, designated generally PR and best shown in FIG. 5, has a cup shaped housing 60 secured to the underside of the fuel reservoir R by cap screws 61. The interior of this housing is divided into chambers 62 and 63 by a flexible diaphragm 64 urged upwardly, as viewed in FIG. 5, by a compression spring 65. A post secured to the center of the pressure regulator diaphragm 64 extends upwardly through an O-ring valve seat 70 and against a ball valve 71 urged downwardly by a compression spring 72. Ball valve 71 is located in the inlet side of pressurized fuel entering the regulator from the pressurizing pump P via a conduit 75 and flows along passage 76. Excess fuel flows into chamber 77 of reservoir R through port 78 whereas fuel at a regulated pressure value flows downwardly past ball valve 71 into regulator chamber 63 and thence into the inlet chamber of metering valve MV if the ball check valve 79 is open. When the engine is not operating, check valve 79 is held closed by a compression spring 80.

Check valve 79 has several functions including that of cutting off the flow of pressurized fluid to the metering valve when the latter is closed thereby avoiding any possibility of loss of fuel into the engine when not operating. Additionally and importantly, a disk 82 fixed to valve shaft 35 is provided with an L-shaped notch 83 overlying check valve 79 (FIG. 7). When the metering valve is closed (FIG. 7), the longer leg of notch 83 lies generally tangent to the top of the check valve and its shorter leg lies tangent to the right-hand side of the check valve. The longer leg of notch 83 acts to cam the check valve to open position when the metering valve shaft is rotated counterclockwise from its closed position, and the shorter leg of notch 83 safeguards against clockwise rotation of the metering valve past its closed position.

Reservoir chamber 77 is sealed closed by a detachable cover 84 (FIG. 5) and is provided close to its top with an excess fuel outlet port 85 opening into a return conduit 86 connected to the fuel tank T by the flow restricter FR, FIG. 1. The fuel outlet port 85 is located near the top of chamber 77 and at a height to maintain a minimum static head of fuel, such as ¼ psi, on the metering valve at all times.

Details of flow restricter FR are shown in FIG. 1 wherein its hollow housing is divided into an inlet and an outlet chamber by a flexible diaphragm 88 urged upwardly by spring 89. A fuel restricter valve 90 is loosely seated and controls flow through a small metering passage through the diaphragm, the valve being urged to a closed position normally by a spring 91. When reservoir chamber 77 is filled with excess fuel above a predetermined pressure, the fuel in the upper chamber of the flow restricter FR depresses the diaphragm until the lower end of the stem of valve 90 strikes the bottom of the flow restricter housing thereby causing valve 90 to open and allow excess fuel to escape along its valve stem, through the ports in the bottom of the flow restricter housing and back to fuel tank T. In this connection, it will be noted that the return line 86 is connected to the vapor space of tank T. In consequence, if the vapor pressure within the tank is above a predetermined value it can flow back to the carburetor through passage 32 (FIG. 1).

Another function and capability of the flow restricter FR is to function as an automatic accumulator to maintain fuel pressure on the metering valve during rapid acceleration as will be explained in detail when describing the operation of the carburetor as a whole.

AUTOMATIC MEANS FOR ENRICHING AND LEANING THE FUEL MIXTURE

The automatic fuel enriching and leaning mechanism is confined to the exterior of the carburetor housing, its structural details being best shown in FIGS. 1, 3 and 9 to 11. The mechanism includes a manifold pressure sensor, designated generally 25, having a rubber diaphragm dividing a supporting housing into a chamber 94 in communication with the atmosphere via vent 95 and a chamber 96 in communication with a mounting tube 23 supported in a boss 92 integral with the exterior of the carburetor housing. The interior of the mounting tube 23 is in communication with an annular chamber 97 which opens into a passage 98 leading into the discharge end of air intake passage 13 at its connection to intake manifold 14 (FIG. 6). A second passage 99 extends upwardly from the annular passage 97 and communicates with 3 way valve 100. The latter is in communication via passage 101' (FIG. 6) with the carburetor intake passage 12. The right-hand end of the operating stem of 3-way valve 100 is provided with an operating arm 101 (FIGS. 3, 9) connected by link 102 to the outer end of an arm 103 secured to the rotary shaft 104 fixed to a spiral bimental thermostat (FIG. 2) in heat exchange with the conduit 107 returning hot exhaust gas from the engine exhaust manifold (not shown) back to the carburetor intake passage 13. The outlet end of the exhaust gas return conduit 107 extends crosswise of the air passageway 13 (FIGS. 5, 6) closely below the idle fuel and air outlets 56 and is provided with a multiplicity of hot gas ports 108. The delivery of hot exhaust gas into the fuel-air via ports 108 is very effective in preheating and vaporizing the fuel. For example, during normal engine operation on a 80° F. day, the fuel-air mixture enters the intake manifold at a temperature typically ranging between 140° F. and 160° F. This aids engine performance and fuel economy substantially.

The flow of hot exhuast gases back to the carburetor via duct 107 is controlled by butterfly valve 110 supported on a shaft crosswise of duct 107 and connected by an arm 111 and a link 112 pivotally connected to the five-sided throttle valve operating link 21 (FIGS. 4 and 14). Since the exhaust gas return valve 110 is operatively connected to the accelerator and throttle valve operating mechanism, it opens in synchronism with depression of the accelerator pedal.

Referring back to the FIGS. 9 and 10 showing the manifold pressure sensor, it is pointed out that the center of the sensor diaphragm 93 is connected to a rod 115 reciprocally supported axially of the housing tube 23 supported by boss 92. Secured to the left-hand end of rod 115 by a set screw 122 is a shank 116 provided at its outer end with a pair of cone-shaped camming surfaces 117, 118 having their larger ends adjacent and merging with one another. These camming surfaces are exposed beyond the left-hand end of the tubular housing 23 and are shiftable axially crosswise of the throttle valve operating linkage assembly. Camming surface 117 terminates in a point and functions as the fuel leaning cam whereas the conical cam 118 constitutes the fuel enriching cam during engine starting and fast idling operation as will be described in detail presently.

Camming surfaces 117 and 118 extend transversely of the length of a roller 120 mounted on a fitting 21 (FIGS. 3, 4, 9, 11) welded or otherwise secured to the longer leg 42 of an L-shaped member having the end of its shorter leg 43 pivoted to the lowermost end of the 5-sided link 21. The outer end of leg 42 is connected by link 41 and arm 38 to the metering valve shaft 35. It will be recalled that the 5-sided link 21 is secured to sleeve 125 (FIGS. 9, 11) journalled about one end of the tubular member 23 of pressure sensor 25. Accordingly, axial reciprocal movement of the pressure sensor and rod 115 crosswise of the roller 120 and of the throttle actuating linkage, is effective to rotate link 42 counterclockwise about the axis of the tubular housing 23 As cams 117, 118 underride roller 120 they rotate the throttle and metering valves independently of the throttle linkage.

Rod 115 secured to the diaphragm of the pressure sensor is surrounded by compression spring 123 (FIGS. 9 and 10) and acts to urge the diaphragm 93 to the relaxed position in which the fuel enriching and leaning cams 117, 118 are retracted and out of contact with the roller 120 as shown in FIG. 9. The supporting shank 116 of cams 117, 118, secured to rod 115 by a set screw 122, is slidable lengthwise of a slot 124 of the tubular housing 23. The 5-sided throttle valve operating link 21 is fixed to a sleeve 125 journalled on the left-hand end of a tubular housing 23, a set screw 122 holding the shank 116 of the cam fitting secured to rod 155 and extending through a semicircular port 127 (FIGS. 9 to 11).

OPERATION—STARTING ENGINE

The position of important carburetor components during engine starting from a cold non-operating condition are represented schematically in FIG. 12 showing certain of the components offset laterally from the carburetor housing and connected thereto by the relevant axes by dotted and dash lines. For example, different portions of the metering valve are offset directly above left-hand corner of FIG. 12 and the metering valve shaft 35 as is indicated by the dot-and-dash line. Likewise, portions of the pressure sensor and of the 3-way valve overlie the position of these components in the carburetor housing and are shown connected to the main view by the dot-and-dash line representing the pressure sensor rod 115. The cam end 117, 118 of the pressure sensor 25 are offset in the lower right-hand corner of FIG. 12 and connected to the fuel enriching and leaning cam 117, 118 of the carburetor housing by the dot-and-dash line 115. The automatic fuel pressure regulator PR is offset to the upper right-hand corner of FIG. 12 and its pressure sensing chamber is shown connected to the 3-way valve 100 by the conduit 67.

FIGS. 13, 14 and 15 employ the same schematic technique just described in connection with FIG. 12 and representing the several components in their relative positions under particular engine operating conditions indicated by the legend applied to each of these Figures When the engine is stopped and cold the fuel metering valve MV is fully closed and its fuel check valve 79 is seated in the L-shaped recess 83 of disk 82 secured to the metering valve shaft 35. Likewise, the two throttle valves 15 in the carburetor air intake passages 12, 12 are fully closed. The fuel pressure regulator PR is then held in its fully open position by spring 65 and the atmospheric pressure applied to its diaphragm 64 via the 3-way valve 100 and duct 67. Hence the ball valve 71 is raised from its seat to allow fuel at the full outlet pressure of the pump P (FIG. 1) to flow past the valve 71 and directly to metering valve MV and to the reservoir chamber 77. The manifold pressure sensor 25 is held in its fully retracted position shown in FIG. 9 by spring 123 with the result that the pointed outer end of its lean fuel camming surface 117 is fully retracted and its cooperating roller 120 attached to the throttle operating linkage is in contact with cam surface 117 close to its apex. This corresponds to the normal non-operating position of the accelerator pedal 30 and the closed positions of both the throttle valves and the fuel metering valve. It is also pointed out that port 130 in the left-hand air intake passage 12 is connected to the ignition distributor to advance the spark during acceleration and that port 131 in the right-hand air intake passage 12 is connected by ducting, not shown, to the engine crank case to conduct crank case fumes into the carburetor for consumption.

With the foregoing in mind, it will be apparent that when the operator turns on the ignition key and slightly depresses the accelerator, the accelerator linkage acts to slightly open the throttle valves 15 and simultaneously to rotate the shaft 35 of fuel metering valve MV clockwise to open the metering valve by a slight amount while simultaneously depressing the check valve 79 thereadjacent to its open position. Cranking the engine by the starter drives the fuel pump P (FIG. 1) to supply fuel at about 5 to 7 psi via duct 75 into the inlet of the fuel pressure regulator PR. Its valve 71 being fully open, high pressure fuel is supplied to the inlet side of metering valve MV and is delivered to the slightly opened crescent shaped port of this valve into the idle air passage 53 (FIGS. 5,12) of the first stage vaporizer of well 48. This fuel and idle air mixture then passes through port 54 into the second stage vaporizer chamber 55 (FIG. 5) and thence to ports 56 into the rapidly flowing air immediately adjacent the open side of throttle valves 15.

As soon as the engine starts, a low pressure prevails in the intake manifold and is conveyed to chamber 96 on the left-hand side of the diaphragm in the manifold pressure sensor (FIGS. 9, 12 ) via passages 97, 98 and the passage in housing 23 opening into chamber 96. Accordingly, the atmospheric pressure admitted to sensor chamber 94 shifts the diaphragm leftward to the position shown in FIG. 11 quickly shifting the sensor rod 115 leftward to move cams 117, 118 to the position shown in FIG. 11. During this movement cams 117, 118 under-ride roller 120. As roller 120 underrides the high area interconnecting cams 117, 118, it operates the throttle linkage to briefly enlarge the opening of both the fuel metering valve and the throttle valves thereby briefly augmenting the enrichment of the fuel-air mixture. Thereafter, roller 120 passes along cam 118 and comes to rest on the supporting shank 116 for the two cams. While so supported, the throttle linkage is positioned to hold the throttle valves and the fuel valve open in a cold engine idling position as shown in FIG. 13. Under these conditions, the fuel pressure regulator is held wide open by the relatively high air pressure present in diaphragm chamber 62 which is in communication with the upper end of air intake passage via duct 67 and 3-way valve 100 positioned as shown in FIGS. 12 and 13. The fuel pressure remains high during initial engine warm-up because the 3-way valve remains positioned as shown in FIGS. 12 and 13 and the thermostat 105 is cold. However, roller 120 is seated against the smaller end of the fuel enrichment cam 118 wherein it is effective to hold the throttle linkage in position to slightly open both the throttle valves 15 and the exhaust gas return valve 110 in duct 107 as shown in FIG. 13.

The small flow of hot exhaust gas leftward along duct 107 serves two functions, namely, heating the thermostat 105 to rotate 3-way valve 100 counterclockwise and, secondly, closes throttle valves 15. Thus, as the thermostat warms, its arm 103 rotates counterclockwise and shifts link 102 and the operating arm 103 (FIG. 12) of valve 100 leftward. As this movement takes place, the short passage of the 3-way valve 100 opens into passage 99 which, as described is in communication via passages 97 and 98 with the subatmospheric pressure then existing in the intake manifold. Concurrently, the longer passage in the 3-way valve is moving out of registry with passage 101.' The thermostat reaches its hot position quite quickly thereby completing the rotation of the 3-way valve 100 to hot engine position and also rotates cam 113 on the shaft of the 3-way valve from the fast idle position shown in FIGS. 12 and 13 to the hot idle position shown in FIG. 14. When in this hot idle position, idle adjusting stop screw **21*b* mounted in tang 21*a* of the 5-sided throttle link 21 shifts counterclockwise thereby closing the throttle valves 15 and also nearly closing the exhaust gas valve 110. The rotation of the 3-way valve 100 to the position shown in FIG. 14 places chamber 62 of the fuel pressure regulator PR in communication with the intake manifold causing the ball valve 71 of the pressure regulator to partially close and reduce the fuel pressure on the metering valve MV to drop to about ¼ psi. Since the throttle valves are closed, a low pressure prevails in the intake manifold which is effective to maintain roller 120 resting against the base of the fuel cam 118 (FIG. 14) so that the fuel metering valve MV remains open in a lean fuel position even though throttle valves 15** are closed.

During hot idle operation, excess fuel overflows from port 85 (FIG. 5) of the fuel reservoir chamber 77 and returns to the fuel tank T via duct 86 and fuel restricter FR (FIG. 1). In this connection it will be recalled that the returning fuel pressure is adequate to depress diaphragm 88 causing valve 90 in that diaphragm to open upwardly as previously described thereby permitting the excess fuel to return to the tank while maintaining the fuel in reservoir chamber pressurized.

ENGINE ACCELERATION AND DECELERATION

Engine operation at cruising, fast acceleration and deceleration will be readily understood from the foregoing detailed description of FIGS. 12 to 14 and the showing in FIG. 15 representing acceleration of a hot engine. Assuming that the operator chooses a rapid acceleration mode, he depresses the accelerator 30 abruptly thereby widely opening the throttle valves 15. This causes the manifold pressure to rise and, in consequence, the pressure in the fuel regulator chamber 62 rises and opens its ball valve further to raise the fuel pressure on the inlet side of the fuel metering valve and augments fuel flow past this valve. More significantly, the sudden increase in the open position of the metering valve permits an augmented fuel flow from reservoir chamber 77. The resulting slight pressure fall there is instantly sensed by the pressurized fuel in the flow restricter FR (FIG. 1) so that its spring 89 and diaphragm 88 move upwardly to displace fuel back into chamber 77 sufficiently to maintain the fuel pressure there and thereby maintain a stumble-free fuel flow during powerful rapid acceleration. Hence, during rapid acceleration the flow restricter acts as an automatic accumulator. Additionally, the rise in manifold pressure due to the abrupt opening of the throttle causes the pressure sensor 25 to shift its cam 117, 118 to under-ride roller 120 of the throttle linkage. This rotates the roller supporting arm 42 and operates link 41 and metering valve arm 38 clockwise and thereby briefly accentuates the opening of the metering valve to enrich the fuel air mixture substantially to support strong stumble-free fast acceleration. Briefly after this abrupt opening of the metering valve, the components resums normal operation and the fuel pressure regulator reestablishes a normal cruising fuel pressure of about 1 psi on the metering valve.

Under deceleration conditions, the accelerator is released allowing the spring biased throttle linkage to close the metering valve MV and throttle valves 15 and fuel metering valve MV. The resulting low manifold pressure immediately lowers the pressure below fuel regulator diaphragm 64. Hence, valve 71 closes leaving the inlet of the metering valve flooded and reservoir chamber 77 flooded with a positive static head of liquid available on the metering valve when re-opened. While the particular pressurized fuel carburetor for an internal combustion engine herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A pressurized fuel carburetor for an internal combustion engine comprising:

a main housing provided with an air intake passage equipped with a normally closed throttle valve connected to an accelerator and which intake passage is unobstructed by other movable air flow responsive means;

engine manifold pressure sensing means located entirely exteriorly of said intake passage but in communication therewith downstream from said throttle valve means; a single normally fully closed fuel metering valve in communication with said air intake passage downstream from said throttle valve and mechanically connected to a source of pressurized fuel and to said accelerator and to said pressure sensing means and responsive to subatmospheric pressure in the engine fuel intake manifold to open said single fuel valve and maintain a continuous flow of pressurized fuel into said air intake passage via said single fuel metering valve so long as said pressure sensig means senses subatmospheric pressure in said intake manifold and responsive to a change in the intake manifold pressure to adjust said single fuel metering valve automatically to vary fuel flow into said intake passage to accommodate changing engine power output demand and to fuly close said single fuel metering valve when said intake manifold pressure rises substantially to atmospheric pressure.

2. A carburetor as defined in claim 1 characterized in that said connection between said manifold pressure sensing means and said single fuel metering valve includes cam means resposive to said pressure sensing means for operating said fuel metering valve automatically and independently of said accelerator.

3. A carburetor as defined in claim 2 characterized in that said cam means is operable in response to rapid decrease in the manifold pressure occurring during acceleration to momentarily enrich the fuel air mixture thereby to expedite smooth and rapid acceleration and then resuming a normal fuel-air ratio under the control of said accelerator and said manifold pressure sensing means.

4. A carburetor as defined in claim 2 characterized in that said cam means is operable in response to an increase in the manifold pressure occurring during deceleration to lean the fuel-air ratio automatically.

5. A carburetor as defined in claim 1 characterized in the provision of means for supplying pressurized fuel to said fuel metering valve including a normally closed check valve, and means operatively interconnecting said fuel metering valve and said check valve for holding said check valve open whenever said fuel metering valve is not in the closed position thereof.

6. A carburetor as defined in claim 1 characterized in the provision of means for supplying pressurized fuel to said fuel metering valve including fuel pressure regulator means provided with a diaphragm-actuated fuel valve including means for selectively connecting said pressure regulator to said carburetor air intake passage on the opposite sides of said throttle valve means and responsive to pressure changes in said air intake passage to regulate the fuel pressure at the outlet side of said fuel pressure regulator means and on the inlet side of said fuel metering valve.

7. A carburetor as defined in claim 6 characterized in that said means for selectively connecting said pressure regulator to the opposite sides of said throttle valve means include 3-way thermal valve means responsive to engine-generated heat to render said pressure regulator responsive solely to engine intake manifold pressure.

8. A carburetor as defined in claim 7 characterized in that said 3-way thermal valve means, when cold, is operable to render said fuel pressure regulator responsive to the air pressure on the inlet side of said throttle valve means whereby said pressure regulator is operable to maintain a relatively high fuel pressure on the inlet to said fuel metering valve, and said thermal valve means, when hot, is operable to connect said pressure regulator to the intake manifold whereupon said pressure regulator is operable to render the fuel pressure on the inlet side of said metering valve responsive to intake manifold pressure.

9. A carburetor as defined in claim 6 characterized in the provision of means for returning excess fuel from said fuel pressure regulator means back to the source of said fuel.

10. A carburetor as defined in claim 9 characterized in that said excess fuel return means includes fuel flow restricter means comprising a chamber divided into an inlet chamber and an outlet chamber by a valve-equipped diaphragm, said inlet chamber being in communication with the inlet of said fuel pressure regulator and said outlet chamber being in communication with the vapor space, of said fuel supply means, and the fuel pressure in said inlet chamber being effective during engine operation to hold the valve of said valve-equipped diaphragm open in a flow restricting position thereof.

11. A carburetor as defined in claim 9 characterized in that said flow restricter means includes means responsive to the abrupt further opening of said fuel metering valve during engine cruising operation to close the valve in said valve-equipped diaphragm and shift fuel from the inlet chamber of said flow restricter means to the inlet side of said fuel metering valve thereby to substantially maintain the fuel pressure on the inlet side of said fuel metering valve while the engine is accelerating.

12. In a carburetor as defined in claim 1 characterized in the provision of an idle air passage in said main housing into which fragmented fuel flows past said fuel metering valve when open, and means for mixing said fragmented fuel and idle air in an expansion chamber centrally of said main carburetor housing and including means for thereafter discharging a multiplicity of jets of vaporized fuel and air into said air intake passage.

13. In a carburetor as defined in claim 12 characterized in the provision of means for discharging hot engine exhaust gases into said carburetor air intake passage downstream from said throttle valve means and from said multiplicity of jets of vaporized fuel and air.

14. In a carburetor as defined in claim 1 characterized in that said manifold pressure sensing means includes pressure responsive cam means movable to-and-fro transversely of the arcuate path of movement of linkage means interconnecting said fuel metering valve and the accelerator, one side of said pressure responsive pressure sensing means being exposed to atmospheric pressure and the other side thereof being in communication with said air intake passage downstream from said throttle valve means, whereby said pressure responsive means is responsive to lowering of the manifold pressure to shift said cam means to a position to augment the open position of said fuel metering valve during initial engine idling operation.

15. In a pressurized fuel carburetor for an internal combustion engine of the type having a carburetor provided with an accelerator actuated throttle-valve-controlled air intake passage, that improvement which comprises:

a normally closed fuel metering valve biased to the closed position thereof and operatively connected to said accelerator for admitting pressurized fuel to said carburetor air intake passage in varying amounts;

stationary diaphragm-equipped pressure sensing means mounted exteriorly of said air intake passage, said pressure sensing means being responsive to engine intake manifold pressure and having cam means actuated by said diaphragm including a pair of oppositely sloping cam surfaces merging with one another and operatively connected with said fuel metering valve said oppositely sloping cam surfaces being mounted coaxially of a rod actuatable by said pressure sensing means and movable crosswise of the movement of said operative connection between said accelerator and said fuel metering valve and effective to vary the rate of fuel flow past said metering valve thereby to automatically lean and enrich the fuel air ratio in response to variations in manifold pressure.

16. A pressurized fuel carburetor as defined in claim 15 characterized in the provision of a liquid fuel chamber normally effective to maintain the inlet side of said fuel metering valve flooded with said pressurized fuel, a fuel supply duct opening into said chamber equipped with a check valve closed when said metering valve is closed, and means operable by the movement of said metering valve toward open position to open said check valve and hold the same open in all open positions of said metering valve.

17. In a pressurized fuel carburetor for an internal combustion engine of the type having a carburetor provided with an accelerator actuated throttle-valve-controlled air intake, that improvement which comprises:

fuel metering valve means including a rotary valve shaft fixed axially to a circular valve disc in planar wiping contact with a circular valve port and the axes of which disc and port are offset from the axis of said shaft along circumferentially spaced apart radial lines, and said disc and port having slightly dissimilar diameters such that said port is closed in one position of said shaft and open in varying amounts as said shaft is rotated toward and away from the closed position thereof;

means operatively interconnecting said valve shaft and said accelerator and normally operable to rotate said valve to the closed position thereof; and means including a fuel pump and fuel pressure regulator means in communication with pressurized fuel and with said air intake downstream from said throttle valve and operable to vary the fuel pressure at said fuel metering valve in response to changing intake manifold pressure.

18. In a pressurized fuel carburetor as defined in claim 17, that improvement which includes a normally closed check valve on the inlet side of said fuel metering valve; and means actuated by the opening movement of said valve disc to open said check valve and maintain the same open so long as said disc valve is open.

19. In a pressurized fuel carburetor as defined in claim 17, that improvement which includes fuel flow restricter means located in a fuel return line interconnecting the vapor space of a fuel supply tank and the fuel inlet of said fuel pressure regulator; said flow restricter including diaphragm-supported normally-closed valve means blocking the return of fuel to said tank and responsive to fuel pressure in excess of a predetermined value to open and bleed excess fuel from the inlet of said fuel pressure regulator back to said tank.

20. In a pressurized fuel carburetor as defined in claim 19, that improvement in said fuel flow restricter means which includes means biasing said diaphragm in a direction to return fuel automatically and momentarily from said flow restricter to the inlet side of said fuel metering valve means in response to sudden further opening of said metering valve means thereby to prevent engine stumble during rapid acceleration.

21. In a pressurized fuel carburetor as defined in claim 19, that improvement in said fuel restricter means wherein the fuel pressure on the inlet side of said fuel metering valve means is normally effective on said flow restricter diaphragm to hold the same in a position to hold said normally closed valve means open if the fuel pressure on the inlet side of said metering valve means rises above a predetermined value.

22. In a pressurized fuel carburetor as defined in claim 19, that improvement in said fuel restricter means including a spring urging said diaphragm in a direction to return fuel from said restricter means back to the inlet side of said fuel metering valve in response to a decrease in fuel pressure on the inlet side of said metering valve; and said normally closed diaphragm-supported normally-closed valve, if open, being automatically movable toward closed position as said diaphragm moves in a direction to return fuel to the inlet side of said metering valve.

* * * * *